US007286099B1

(12) United States Patent
Lier et al.

(10) Patent No.: US 7,286,099 B1
(45) Date of Patent: Oct. 23, 2007

(54) ROTATION-INDEPENDENT HELICAL ANTENNA

(75) Inventors: Erik Lier, Newtown, PA (US); Bernard F. Lindinger, Elkins Park, PA (US); Leon R. Smolenski, Perkasie, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 139 days.

(21) Appl. No.: 11/217,439

(22) Filed: Sep. 2, 2005

(51) Int. Cl.
*H01Q 1/36* (2006.01)

(52) U.S. Cl. ..... 343/895

(58) Field of Classification Search ..... 343/895, 343/715, 900
See application file for complete search history.

(56) References Cited

U.S. PATENT DOCUMENTS

| | | | | |
|---|---|---|---|---|
| 2,982,964 | A * | 5/1961 | Bresk et al. | 343/895 |
| 4,097,867 | A * | 6/1978 | Eroncig | 343/715 |
| 6,172,655 | B1 * | 1/2001 | Volman | 343/895 |
| 6,181,296 | B1 * | 1/2001 | Kulisan et al. | 343/895 |
| 6,198,449 | B1 * | 3/2001 | Muhlhauser et al. | 343/753 |
| 7,142,171 | B1 * | 11/2006 | Patel et al. | 343/895 |
| 2004/0257298 | A1 * | 12/2004 | Larouche et al. | 343/895 |

* cited by examiner

*Primary Examiner*—Hoanganh Le
(74) *Attorney, Agent, or Firm*—McDermott Will & Emery LLP

(57) ABSTRACT

A helical antenna having a central axis defined between a base end and a distal end comprises a helical conductor wound about the central axis and having a feed line disposed at the base end and along the central axis, and may also include an elongated dielectric core about which the electrical conductor is wound.

18 Claims, 5 Drawing Sheets

ROTATION-INDEPENDENT HELICAL ANTENNA

STATEMENT AS TO RIGHTS TO INVENTIONS MADE UNDER FEDERALLY SPONSORED RESEARCH OR DEVELOPMENT

Not Applicable.

TECHNICAL FIELD

This disclosure relates to phased antennas and, particularly, relates to helical antennas.

BACKGROUND

One form of antenna widely used for communication and radar purposes is a helical (or helix) antenna. A helical antenna is an antenna that emits or responds to electromagnetic (EM) fields in a circular polarization. Maximum radiation or response is wanted along the axis of the helix, about which the helical coil is disposed. A set of helical antennas may be mounted together to form an array, or phased array, antenna. In customary applications, the spacing in an array is larger than half of a wavelength.

A helical antenna comprises an electrically conductive helical coil that can transmit or receive, or both, EM signals. The antenna properties of the helical coil are a function of several of its physical characteristics, including axial length, turn spacing and diameter (or radius) of the coil. The helical antenna extends orthogonally from a ground plane, at its base (or first) end, to its distal (or second) end. Typical helical antennas either have a uniform radius or they are axially tapered from the antenna's base to its distal end.

The helical coil includes, at its base, a feed line that connects the antenna, through the ground plane, to the receiver, transmitter, or transceiver—depending on the type of antenna. The feed line transfers radio-frequency (RF) energy from a transmitter to an antenna, and/or from an antenna to a receiver, but, if operating properly, the feed line typically does not radiate or intercept energy. In a typical helical antenna arrangement, the feed line is offset from the axis of the helical coil and typically coupled through the ground plane to an amplifier or filter.

Generally, there are three types of commonly used antenna feed lines, also called RF transmission mediums: coaxial line, waveguide and strip line/micro-strip line. These are typically used to transmit or receive RF signals to and from the helical coil. A coax cable is a shielded copper-core channel that carries the signal, surrounded by a concentric second channel cable that serves as ground and is covered by an outer sheathing. A waveguide is a hollow, metallic tube or pipe with a circular or rectangular cross section. The diameter of the waveguide is comparable to the wavelength of the EM field, typically. The EM field travels along the inside of the waveguide. The metal structure prevents EM fields inside the waveguide from escaping, and also prevents external EM fields from penetrating to the interior. Waveguides are used at microwave frequencies, that is, at 1 GHz and above. Strip line or micro-strip lines are planar transmission mediums used in, among other things, RF applications. Strip lines or micro-strip lines may be integral with, mounted on or etched into the ground plane.

A helical antenna is an "axial mode" antenna, meaning it preferably radiates or receives energy primarily along its axis. From an RF perspective, the helical antenna has two primary characteristics that are of importance. The first is amplitude, which is a measure of the magnitude of the RF signal. The amplitude should be at its maximum along the axis of the helical coil. For the most part, amplitude is independent of the rotation of the coil about the axis. The second characteristic is phase, which reflects the frequency characteristics of the signal. Unlike amplitude, the phase of the helical antenna is directly related to the rotational orientation of the helical coil about the axis. For example, a quarter turn of the coil effects a 90° change in phase, a half turn effects a 180° change in phase, and so forth. Thus, the rotational orientation of a helical antenna, particularly within an array of antennas, is important.

In order to achieve the desired radiation pattern for such a helical antenna, whether in an array or alone, a helical antenna may require rotation about its axis. Consequently, once the antenna is located, for example within an array, it may not be freely spun about its axis without adversely impacting antenna performance. For example, rotating such a helical antenna within an array could result in coupling with one or more adjacent helical antennas. Further, with an offset feed line, if the antenna is rotated, then the amplifier/filter typically connected to the feed line would need to be repositioned. This can be particularly time consuming and onerous Thus, rotation of a helical antenna about its axis could require at least two compensating actions, one is EM related and the other more layout related. First, to eliminate or mitigate undesirable levels of coupling, the physical locations and spacing of the helical antennas within the array may need to be customized. And once placed, any rotation of a helical antenna within the array would likely require modification to the placement of that antenna within the array. Second, since each helical antenna is physically connected to an amplifier/filter module, rotation of the antenna would likely requirement movement or rewiring of the helical antenna to its amplifier/filter module. Thus, current helical antennas having off-set feed lines have limited flexibility.

SUMMARY OF THE DISCLOSURE

The subject matter disclosed herein solves the above problems by providing a helical antenna that is relatively independent of rotation (e.g., "clocking" or "spinning") about its central axis. That is, while the amplitude of a helical antenna is relatively independent of its rotation about its axis, such antennas are "clocked" (or rotated about the central axis) to adjust their phase. As provided herein, in such a helical antenna, the antenna's feed line is center fed, allowing rotation of the antenna without requiring rewiring or repositioning of any related components. Further, the distal portion of such antennas may be tapered to improve axial ratio, regardless rotation about the axis.

In accordance with one embodiment, a helical antenna comprises a base end and a distal end, and further comprises an elongated dielectric core formed about a central axis between the base end and the distal end, and an electrical conductor coaxial with and wound about the core, the conductor including a feed line disposed at the base end and along the central axis. The feed line may be configured to couple to a transmission path comprising at least one of a coaxial cable, waveguide, strip line, or micro-strip line. The core may take the form of a cruciform. In some arrangements, the core may define an opening at the base end and the feed line may include a bridge section that is disposed through the opening and to the central axis.

In such a helical antenna, the electrical conductor may comprise an axially tapered end formed at the distal end, the tapered end decreasing in radius along the central axis and in the direction of the distal end. The electrical conductor may also comprise an axially tapered midsection disposed between the feed line and tapered end, the midsection having a taper angle smaller than a taper angle of the first tapered end relative to the central axis. Regardless of the midsection, the electrical conductor tapered end may be formed of up to two turns, in some arrangements. Preferably, the tapered end is configured to improve axial ratio.

In accordance with another embodiment, a helical antenna is formed from a freestanding, electrically conductive helical coil that includes a base end and a distal end, and comprises an elongated electrical conductor wound about a central axis, the conductor including a feed line configured to be disposed at the base end and along the central axis. The feed line may be configured to couple to a transmission path comprising at least one of a coaxial cable, waveguide, strip line, or micro-strip line.

In various arrangements, the helical coil may comprise an axially tapered end formed at the distal end, the tapered end decreasing in radius along the central axis and in the direction of the distal end. The helical coil may also comprise an axially tapered midsection disposed between the feed line and tapered end, the midsection having a taper angle smaller than a taper angle of the first tapered end relative to the central axis, in the direction of the distal end. Regardless of the midsection, the helical coil tapered end may be formed of up to two turns, in some arrangements. Preferably, the tapered end is configured to improve axial ratio.

In another embodiment, a helical antenna includes a central axis defined between a base end and a distal end. The helical antenna comprises an elongated dielectric core formed about the central axis between the base end and the distal end and a helical coil coaxial with and wound about the core. The core may take the form of a cruciform. The conductor comprises a feed line formed at the base end and along the central axis, an axially tapered end formed at the distal end, the tapered end decreasing in radius along the central axis and in the direction of the distal end. In any of the various arrangements the feed line may be configured to couple to a transmission path comprising at least one of a coaxial cable, waveguide, strip line, or micro-strip line.

The tapered end of the helical coil may be formed of up to two turns of the helical coil, as an example. In various arrangements the tapered end is configured to improve axial ratio. The conductor may also comprise a midsection disposed between the feed line and tapered end, the midsection having a taper angle smaller than a taper angle of the first tapered end relative to the central axis, in the direction of the distal end.

In another embodiment, provided is a method of making a helical antenna comprising the steps of winding an elongated electrical conductor about a central axis, the conductor having a base end and a distal end. The steps include forming an axially tapered end of the antenna by tapering the conductor in decreasing radius along the central axis and in the direction of the distal end and forming a feed line at the base end along the central axis. The method may further comprise forming a midsection disposed between the feed line and tapered end, the midsection having a taper angle smaller than a taper angle of the first tapered end relative to the central axis, in the direction of the distal end. In the various arrangements, the method may include winding the conductor around an elongated dielectric core formed about the central axis. In such a case, the core may take the form of a cruciform.

The method may also include the steps of forming the tapered end with up to two turns of the conductor. In various arrangements, the method includes forming the tapered end to achieve improved axial ratio. And, the method may comprise the step of forming the feed line to couple to a transmission path comprising at least one of a coaxial cable, waveguide, strip line, or micro-strip line.

In yet another embodiment, provided is a method of adjusting a phase of a helical antenna. The helical antenna comprises an elongated helical coil having a central axis disposed between a base end and a distal end and a feed line disposed at the base end. The method comprises the steps of rotatably mounting the base end of the helical antenna to a substrate such that the helical antenna is substantially oriented for at least one of axial mode radiation or reception, disposing the feed line along the central axis and providing a transmission path comprising a coupling junction disposed at the central axis, coupling the feed to the coupling junction, and rotating the helical antenna about the central axis until a desired phase is achieved, without decoupling the feed line from the coupling junction.

In various arrangements, the transmission path comprises at least one of a coaxial cable, waveguide, strip line, or micro-strip line. And, the helical antenna may include an axially tapered end formed at the distal end and decreasing in radius along the central axis and in the direction of the distal end.

Additional advantages and aspects of the present disclosure will become readily apparent to those skilled in the art from the following detailed description, wherein embodiments of the present invention are shown and described, simply by way of illustration of the best mode contemplated for practicing the present invention. As will be described, the present disclosure is capable of other and different embodiments, and its several details are susceptible of modification in various obvious respects, all without departing from the spirit of the present disclosure. Accordingly, the drawings and description are to be regarded as illustrative in nature, and not as limitative.

DETAILED DESCRIPTION OF THE EMBODIMENTS

A helical antenna is provided that can be rotated or spun about its central axis (or "clocked") to adjust its phase without requiring relocation of the antenna or components that couple to the antenna as a result of the clocking. Although, the phase changes with rotation, the amplitude of the antenna is substantially independent of its rotation about its central axis. The helical antenna includes an electrical conductor formed about the central axis, and includes a base end and a distal end. The rotational freedom of the antenna is accomplished by, for example, disposing or forming a feed line at the base end of the antenna and along the central axis. The feed line couples to a transmission path, through a ground plane, to allow signals to be provided to the coil for radiation or signals received by the coil to be provided to signal processing modules. The helical antenna may be a free standing helical coil, or the coil may be wound around a dielectric core, such as, for example, a cruciform.

Preferably, the helical antenna is configured to achieve an axial ratio of about 1 dB, or less. To accomplish this, the portion of the helical coil at the distal end may be axially tapered, such that its radius decreases along the central axis and in the direction of the distal end. As an example, at the tapered end the circumference of the helical antenna may be about one wavelength or less. In various embodiments, the diameter of the tapered end may be reduced by a factor of about 2 over about 1-2 windings of the helical coil. In some embodiments the tapered end may be formed from up to 2 windings of the helical coil. In other embodiments, a different number of windings may be required to achieve the desired performance of the antenna. Thus, variations are intended to fall within the scope hereof.

Figure 1A:
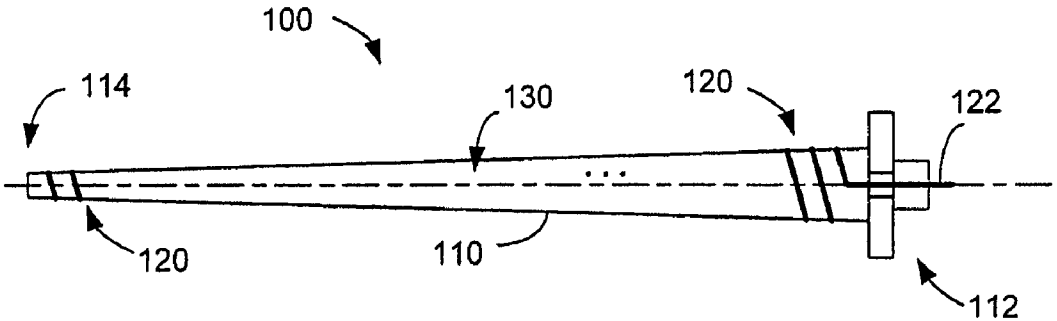
FIGS. 1A-C are diagrammatic views of a tapered helical antenna.

Referring to FIG. 1A, a side view of a representative helical antenna is shown, as a tapered helical antenna 100. Helical antenna 100 comprises a dielectric core 110 about which an electrically conductive helical element or coil 120 is disposed. In the embodiment of FIG. 1A the core 110 is a dielectric core in the form of a cruciform and the helical coil 120 is comprised of an electrically conductive material, such as copper. In operation, the helical antenna 100 may be configured to transmit or radiate energy, receive energy or both. Such a helical antenna may be used alone or as part of an antenna array comprising a plurality helical arrays. In such a case, the antenna array may be a phased array antenna, which could, for example, be mounted on a satellite.

The cruciform 110 may be elongated and tapered, having a substantially conical outer shape, as is shown. Although in other embodiments the cruciform and coil need not be tapered, e.g., could be cylindrical, or could be only partially tapered, e.g., at its distal end. The cruciform may also be defined as having a lengthwise central axis 130. The cruciform includes a base end 112 that may be configured to couple, secure or mount to a substrate 125 or transmission path or medium (not shown), such as a coax cable, waveguide, strip-line or micro-strip line. In the case of a substrate, the substrate may include or facilitate coupling of the helical antenna to such a transmission medium. In any case, a ground plane (not shown) may be defined from which the helical antenna orthogonally extends. Thus, the central axis 130 would also be orthogonal to the ground plane.

The radiation from such a helical antenna is primarily directed from a distal end 114 of the helical antenna 100, along the central axis 130. The main lobe of the radiated beam should include a substantial portion of the radiated power and is directed along the central axis 130. Such an arrangement defines an "axial mode" antenna, as opposed to less common or desirable side-radiating antennas, i.e., antennas that radiate a substantial portion of their energy from the sides of the antennas or having relatively high side lobes. Other energy not forming part of the main lobe may be found in side lobes, which should be significantly lower in power than the main lobe (see, for example, FIG. 6). Tapering the helix as described herein results in relatively low side lobes, and thus more energy in the main lobe.

The helical coil 120 is wound around the cruciform 110. As will be appreciated by those skilled in the art, the spacing between the windings or turns 124 of the helical coil 120 can be uniform or varied—to the extent necessary to manipulate or achieve or accommodate a desired beam. A first end of the helical coil 110 is disposed proximate to the base end 112 of the cruciform 110 and a second end of the helical coil is disposed proximate to the distal end 114 of the cruciform. The first end of the helical coil includes a feed end 122 that is substantially disposed along the central axis 130. As is shown in FIG. 1A, the feed end 122 may extend through the base end 112 of the cruciform where it may then be coupled to a transmission medium, such as a waveguide, for example. The feed end 122 may also be comprised of the same material as the rest of the helical coil 120—i.e., an electrically conductive material. For instance, the feed end 122 may be formed as an extension of the helical coil 120. In other embodiments, the feed end 122 may be formed of a different material or as a different element—so long as it is configured to serve as a transmission path for the signals received or to be transmitted by the helical antenna 100.

Figure 1C:
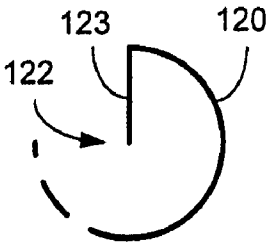
Figure 1D:
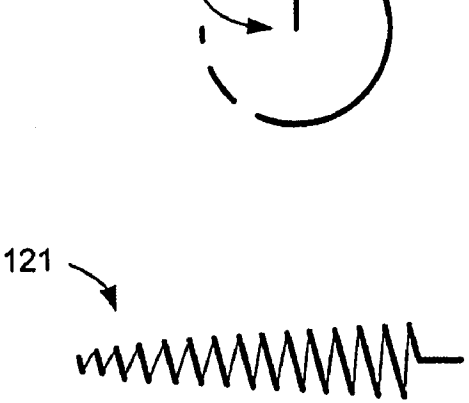
FIG. 1D is a side view of a helical coil.
Figure 1B:
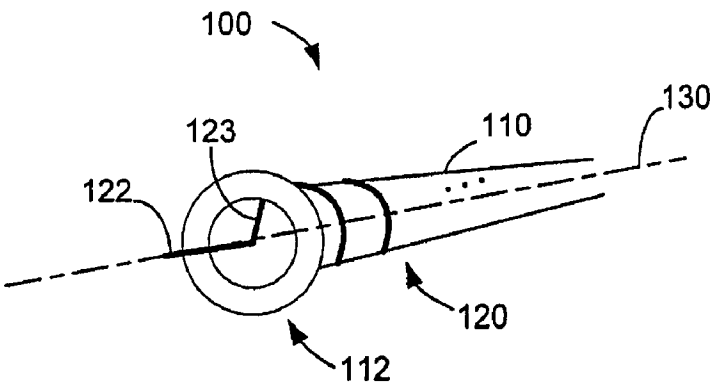

Referring to FIG. 1B, a perspective view of the helical antenna of FIG. 1A is shown. As can be seen from this perspective, the feed end 122 is, in fact, disposed along (or coaxially with) the central axis 130 and extends from the base end 112 of the cruciform 110. Referring to FIG. 1C, a bottom view of the helical coil 120 of FIG. 1A and FIG. 1B is shown, without the cruciform. As can be seen from this figure, the feed end 122 includes a bridge member 123 that bridges the path between the winding portion 124 of the helical coil 120 near the base end 112 of the cruciform 110 to the feed end 122. In FIG. 1C, the feed end 122 extends orthogonally out of the page and the bridge member 123 is oriented substantially orthogonal to the central axis 130. In this embodiment, the configuration of the bridge member 123 achieves a return loss of about 20 dB or better.

In other embodiments, the helical antenna may take the form of a free standing helical coil 121, without a core, as is shown in FIG. 1D.

Figure 2A:
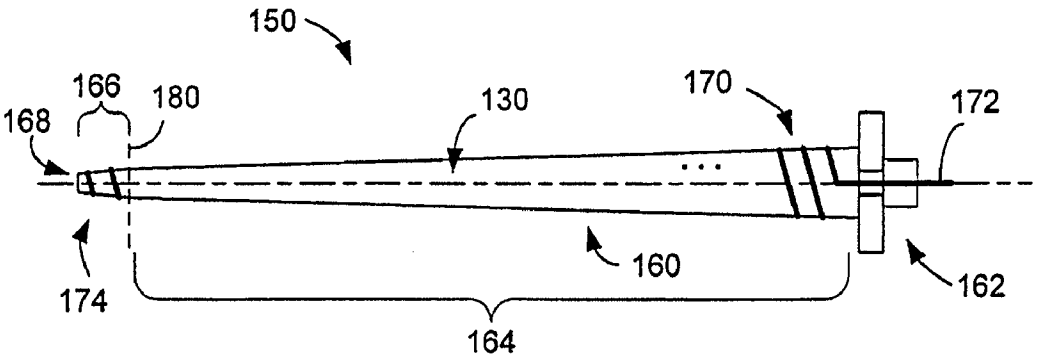
FIGS. 2A-2B are diagrammatic views of an alternative tapered helical antenna.

Referring to FIG. 2A, a side view of a helical antenna 150 is provided. Like the helical antenna 100 of FIG. 1A, helical antenna 150 includes a cruciform and an electrical helical coil that are coaxial about central axis 130. However, in this embodiment, the cruciform 160 of helical antenna 150 includes two regions having different taper angles relative to the central axis. A first region 164 extends from a base end 162 of cruciform 160 to a transition point indicated by dashed line 180. The radius of the cruciform and helical coil is greater at the base end than at the transition point. The second region 166 of the cruciform 160 extends from the transition point at line 180 to a distal end 168 of the cruciform 160. The radius of the cruciform and helical coil is greater at the transition point than at the distal end. In other embodiments, a cruciform having more than two regions with different taper angles may be used.

Like the cruciform 160, a helical coil 170 of helical antenna 150 also includes two regions that have the same corresponding taper angles. A center feed 172 portion of helical coil 170 extends through the base end 162 of the cruciform and along the central axis 130, as with the helical coil of FIG. 11A. The winding of helical coil 170 tapers from the base end 162 to the transition point indicated by dashed line 180. The radius of the helical coil is greater at the base end than at the transition point. From the transition point indicated by dashed line 180, the taper angle of the helical coil 170 changes, tapering until reaching the distal end 168. This portion of coil 170, indicated in FIGS. 2A and 2B as portion 174, is disposed on the second region 166 of cruciform 160 and has a corresponding taper angle. The radius of the helical coil is greater at the transition point than at the distal end. In other embodiments, a helical coil having more than two regions with different taper angles may be used.

Figure 2B:
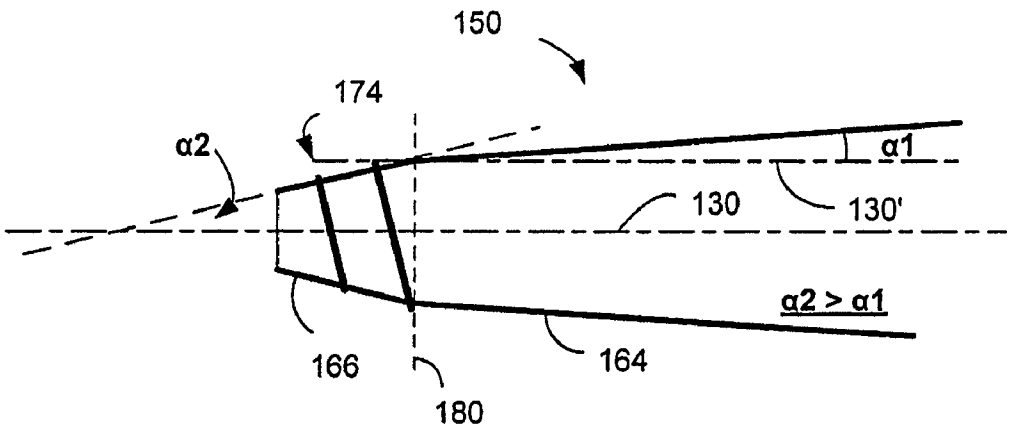

Referring to FIG. 2B, a detailed side view of the helical antenna 150 of FIG. 2A is shown. The taper angle of the first region 164 of cruciform 160 is measured from a line 130', which is parallel to central axis 130. The taper angle for the first region is represented by al. The taper angle of the second region 166 is measured from central axis 130, and is represented by $\alpha 2$. In this embodiment, $\alpha 2 > \alpha 1$. The taper angle of the second region 166 and helical coil 174 (i.e., $\alpha 2$) is configured to improve the axial ratio of the radiated signal. In the preferred embodiment, the distal portion 174 of helical coil 170 includes 2 turns, which has been shown for this embodiment to achieve improved axial ratio over, for example, a helical antenna without such a tapered end.

Figure 4:
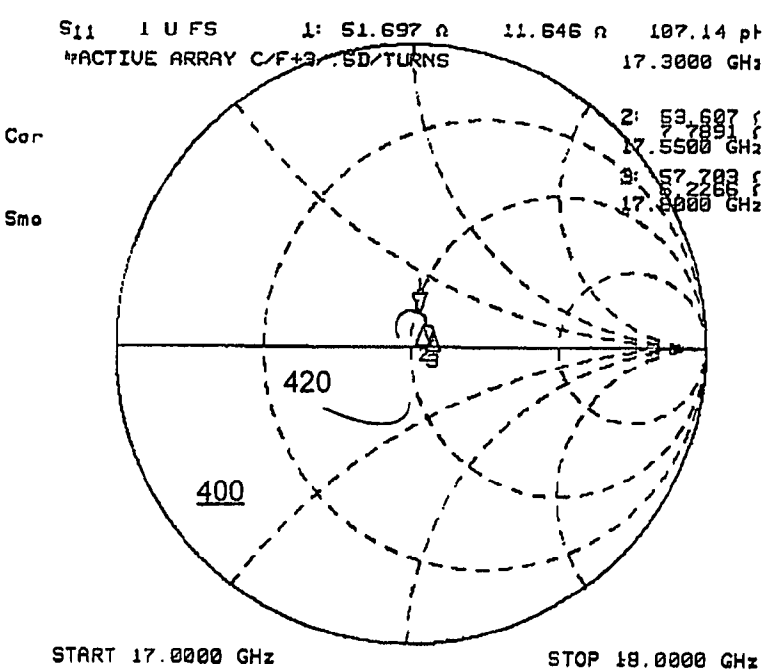
FIGS. 3 and 4 are graphs of response-loss performance of the antenna of FIGS. 2A-2B.
Figure 3:
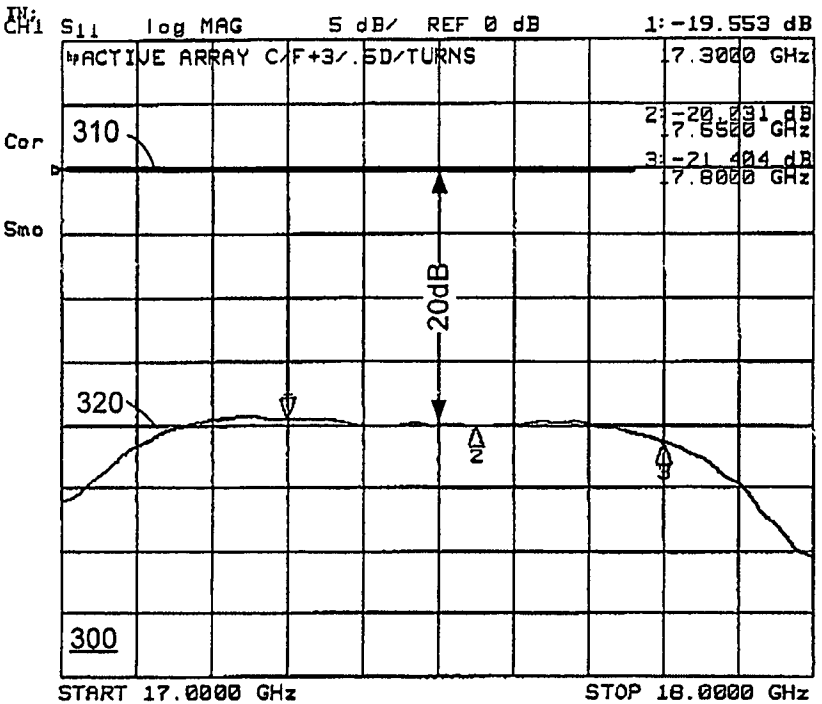

Referring to FIG. 3, a chart 300 is shown, which plots the negative return loss versus frequency for the helical antenna 150 of FIG. 2A and FIG. 2B. The marked frequencies are: (1) 17.3 GHz; (2) 17.55 GHz; and (3) 17.8 GHz. These frequencies represent low, mid, and high frequencies, respectively, in the frequency band of interest for this particular antenna. For other antennas, a different frequency band could be of interest. Input power is indicated by line 310. The measured power is indicated by line 320. The power at frequency (1) is indicated by point 1, which represents a return loss of about 19.553 dB. The power at frequency (2) is indicated by point 2, which represents a return loss of about 20.031 dB. The power at frequency (3) is indicated by point 3, which represents a return loss of about 21.404 dB. Thus, at each of these frequencies the return loss is about 20 dB. FIG. 4 is also a plot 400 a Smith chart corresponding to the plot of FIG. 3—Smith charts are known by those skilled in the art. The plotted points 1, 2, and 3 relate to the above measurements at each of frequencies (1), (2) and (3), respectively.

Figure 5A:
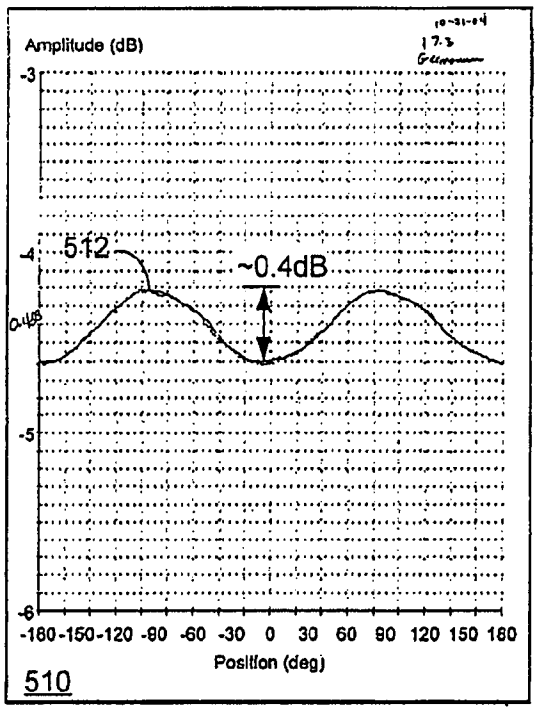
FIGS. 5A-C are graphs of axial ratio measurement at different frequencies for the antenna of FIGS. 2A-2B.
Figure 5B:
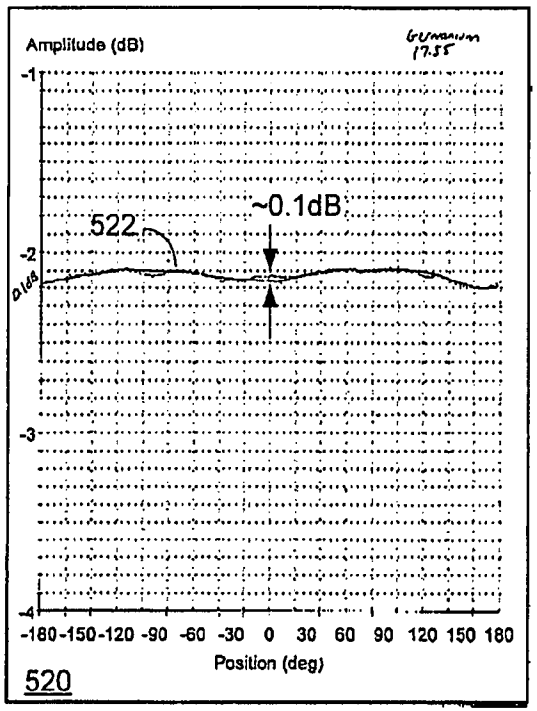
Figure 5C:
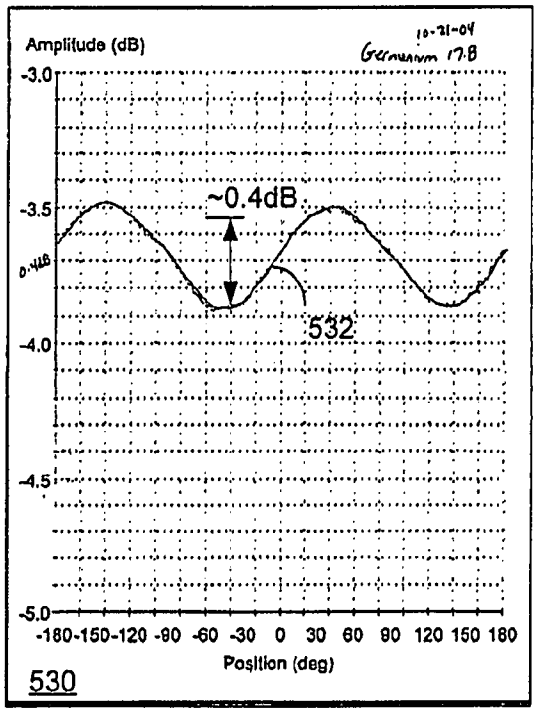

Referring to FIGS. 5A-5C, at each of the marked frequencies (1), (2) and (3), the minimum value minus the maximum value corresponding to boresight axial ratio (AR) is plotted. Specifically, each of these figures shows a graph of amplitude in dB versus angle of rotation about the central axis of the antenna. As can be seen from the plot 512 of graph 510 in FIG. 5A, the AR is about 0.4 dB. As can be seen from the plot 522 of graph 520 in FIG. 5B, the AR is about 0.1 dB. As can be seen from the plot 532 of graph 530 in FIG. 5C, the AR is about 0.4 dB.

Figure 6:
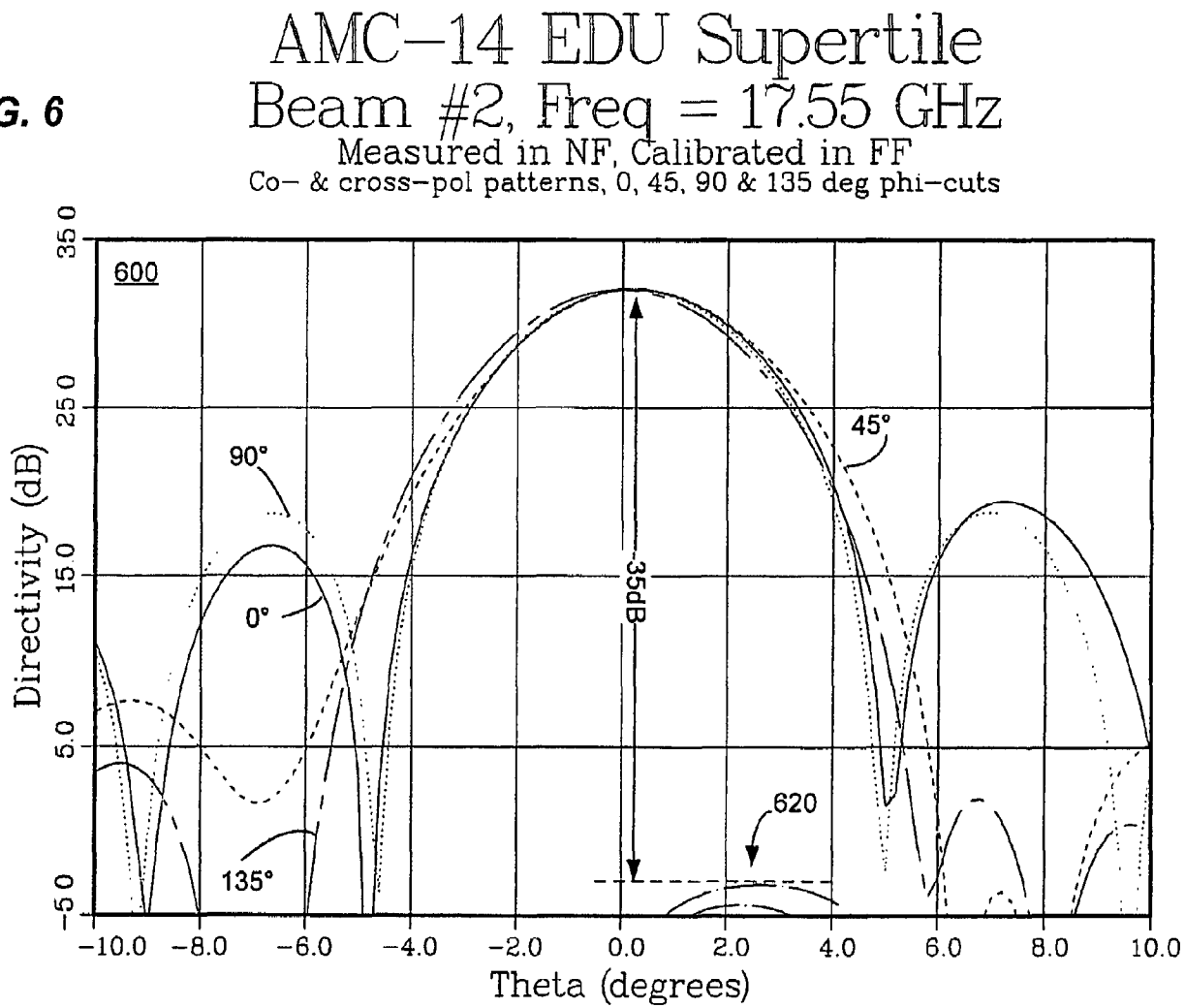
FIG. 6 is a graph of the directivity at various spin angles for the antenna of FIGS. 2A-2B.

Referring to FIG. 6, a graph 600 is shown of directivity in dB versus rotation in degrees (indicated as "THETA") relative to the direction of radiation (i.e., the central axis 130) for the frequency (2) above (i.e., 17.55 GHz). The graph includes four plots, one plot at each of four different rotation (or spin) angles about the central axis 130. The four spin angles are 0, 45, 90 and 135 degrees. The plots of FIG. 6 are marked according to their respective spin angles. As can be seen, the main lobe of the radiation pattern is substantially the same, regardless of the spin angle.

The relative peak of cross polarization is indicated by the segments 620—where the lower the better. In FIG. 6 the cross-polarization relative to peak co-polarization is about −35 dB, as is shown. Similar plots could also be made at frequency (1) and (3) above. Measured cross-polarization per helical antenna is under 32.8 dB over the above frequency band of 17.3 GHz −17.8 GHz (with an axial ratio of about 0.4, worst-case). Analogous results would be expected for antennas designed to transmit and receive in other frequency bands. The above frequency band is merely exemplary.

A number of implementations have been described. Nevertheless, it will be understood that various modifications may be made. Accordingly, other implementations are within the scope of the following claims.

What is claimed is:

1. A helical antenna having a central axis defined between a base end and a distal end, the helical antenna comprising:

A. an elongated dielectric core formed about the central axis between the base end and the distal end; and B. a helical coil coaxial with and wound about the core, the helical coil comprising:

1) a feed line formed at the base end and along the central axis;

2) an axially tapered end formed at the distal end, the tapered end decreasing in radius along the central axis and in the direction of the distal end; and 3) a midsection disposed between the feed line and tapered end, the midsection having a taper angle smaller than a taper angle of the tapered end relative to the central axis and in the direction of the distal end.

2. The helical antenna of claim 1 wherein the feed line is configured to couple to a transmission path comprising at least one of a coaxial cable, waveguide, strip line, or micro-strip line.

3. The helical antenna of claim 1 wherein the tapered end is formed of up to two turns of the helical coil.

4. The helical antenna of claim 1 wherein the tapered end is configured to achieve an axial ratio of about 1 dB or less.

5. The helical antenna of claim 1 wherein the core is a cruciform.

6. A method of making a helical antenna comprising the steps of:

A. winding an elongated electrical conductor about a central axis, the electrical conductor having a base end and a distal end, including:

1) forming an axially tapered end by tapering the conductor in decreasing radius along the central axis and in the direction of the distal end;

2) forming a feed line at the base end along the central axis; and 3) forming a midsection disposed between the feed line and the tapered end, the midsection having a taper angle smaller than a taper angle of the tapered end relative to the central axis and in the direction of the distal end.

7. The method of claim 6 wherein step A includes the step of winding the conductor around an elongated dielectric core formed about the central axis.

8. The method of claim 6 wherein the core is a cruciform.

9. The method of claim 6 wherein step A. 1) includes the step of forming the tapered end with up to two turns of the conductor.

10. The method of claim 6 wherein step A. 1) includes the step of forming the tapered to achieve an axial ration of about 1 dB or less.

11. The method of claim 6 wherein step A. 2) includes the step of forming the feed line to couple to a transmission path comprising at least one of a coaxial cable, waveguide, strip line, or micro-strip line.

12. A method of adjusting a phase of a helical antenna, the helical antenna comprising an elongated helical coil having a central axis disposed between a base end and a distal end and a feed line disposed at the base end, the method comprising the steps of:

A. rotatably mounting the base end of the helical antenna to a substrate such that the helical antenna is substantially oriented for at least one of radiation or reception in the direction of the central axis;

B. disposing the feed line along the central axis and providing a transmission path comprising a coupling junction disposed at the central axis;

C. coupling the feed line to the coupling junction; and

D. rotating the helical antenna about the central axis until a desired phase is achieved, without decoupling the feed line from the coupling junction.

13. The method of claim 12, wherein the transmission path comprises at least one of a coaxial cable, waveguide, strip line, or micro-strip line.

14. The method of claim 12 wherein helical antenna includes an axially tapered end formed at the distal end and decreasing in radius along the central axis and in the direction of the distal end.

15. A helical antenna having a central axis defined between a base end and a distal end, the helical antenna comprising:

A. a helical coil coaxial with and wound about the central axis, the helical coil comprising:

1) a feed line formed at the base end and along the central axis;

2) an axially tapered end formed at the distal end, the tapered end decreasing in radius along the central axis and in the direction of the distal end; and 3) a midsection disposed between the feed line and tapered end, the midsection having a taper angle smaller than a taper angle of the tapered end relative to the central axis and in the direction of the distal end.

16. The helical antenna of claim 15 wherein the feed line is configured to couple to a transmission path comprising at least one of a coaxial cable, waveguide, strip line, or micro-strip line.

17. The helical antenna of claim 15 wherein the tapered end is formed of up to two turns of the helical coil.

18. The helical antenna of claim 15 wherein the tapered end is configured to achieve an axial ratio of about 1 dB or less.

* * * * *

UNITED STATES PATENT AND TRADEMARK OFFICE

CERTIFICATE OF CORRECTION

PATENT NO. : 7,286,099 B1
APPLICATION NO. : 11/217439
DATED : October 23, 2007
INVENTOR(S) : Erik Lier et al.

It is certified that error appears in the above-identified patent and that said Letters Patent is hereby corrected as shown below:

In claim 10, column 8, line 60, "forming the tapered to achieve" should read -- forming the tapered end to achieve --.

Signed and Sealed this

Twenty-sixth Day of August, 2008

JON W. DUDAS
*Director of the United States Patent and Trademark Office*